US008466085B2

(12) United States Patent
Kato et al.

(10) Patent No.: US 8,466,085 B2
(45) Date of Patent: Jun. 18, 2013

(54) THERMOSENSITIVE RECORDING MEDIUM

(75) Inventors: Aya Kato, Tokyo (JP); Tatsuyuki Kurihara, Tokyo (JP); Tatsuo Nagai, Tokyo (JP); Yoshimi Midorikawa, Tokyo (JP); Kenji Hirai, Tokyo (JP); Akihito Ogino, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 782 days.

(21) Appl. No.: 12/675,701

(22) PCT Filed: Dec. 19, 2007

(86) PCT No.: PCT/JP2007/074385

§ 371 (c)(1),
(2), (4) Date: Feb. 26, 2010

(87) PCT Pub. No.: WO2009/028118

PCT Pub. Date: Mar. 5, 2009

(65) Prior Publication Data

US 2010/0248959 A1 Sep. 30, 2010

(30) Foreign Application Priority Data

Aug. 29, 2007 (JP) ..... 2007-222623

(51) Int. Cl.
*B41M 5/337* (2006.01)

(52) U.S. Cl.
USPC ..... 503/209; 503/214

(58) Field of Classification Search
None
See application file for complete search history.

(56) References Cited

U.S. PATENT DOCUMENTS

| | | | | |
|---|---|---|---|---|
| 4,032,690 | A | 6/1977 | Kohmura et al. | |
| 4,243,716 | A | 1/1981 | Kosaka et al. | |
| 4,265,978 | A | 5/1981 | Morishita et al. | |
| 6,037,308 | A | 3/2000 | Sato et al. | |
| 6,656,880 | B2 | 12/2003 | Aono | |
| 6,680,281 | B2 | 1/2004 | Tajiri et al. | |
| 7,157,407 | B2 * | 1/2007 | Serizawa | 503/200 |
| 7,618,922 | B2 | 11/2009 | Ogino et al. | |
| 8,129,307 | B2 | 3/2012 | Makihara et al. | |
| 8,247,347 | B2 | 8/2012 | Takagi et al. | |
| 8,283,284 | B2 | 10/2012 | Hirai et al. | |
| 2003/0045426 | A1 | 3/2003 | Ito | |
| 2004/0198603 | A1 | 10/2004 | Kawakami et al. | |
| 2004/0241598 | A1 | 12/2004 | Suga et al. | |
| 2005/0118526 | A1 | 6/2005 | Suga et al. | |
| 2006/0264326 | A1 | 11/2006 | Fisher et al. | |
| 2008/0139385 | A1 | 6/2008 | Ogino et al. | |
| 2008/0214786 | A1 | 9/2008 | Oyama | |
| 2010/0062935 | A1 | 3/2010 | Takagi et al. | |
| 2010/0099557 | A1 | 4/2010 | Makihara et al. | |
| 2011/0105319 | A1 | 5/2011 | Hirai et al. | |
| 2011/0130281 | A1 | 6/2011 | Kurihara et al. | |
| 2011/0269622 | A1 | 11/2011 | Ohse et al. | |
| 2012/0038737 | A1 | 2/2012 | Hirai et al. | |
| 2012/0129692 | A1 | 5/2012 | Ohse et al. | |

FOREIGN PATENT DOCUMENTS

| | | |
|---|---|---|
| EP | 0 465 665 | 1/1992 |
| EP | 0 764 635 | 3/1997 |
| EP | 0 779 539 | 6/1997 |
| EP | 1 116 713 | 7/2001 |
| EP | 1 199 185 | 4/2002 |
| EP | 1 367 437 | 12/2003 |
| EP | 1 437 231 | 7/2004 |
| EP | 1 747 898 | 1/2007 |
| EP | 1 808 304 | 7/2007 |
| EP | 2 072 274 | 6/2009 |
| EP | 2 145 771 | 1/2010 |
| GB | 2 187 297 | 9/1987 |
| JP | 53-091995 | 8/1978 |
| JP | 54-128349 | 10/1979 |
| JP | 57-165290 | 10/1982 |
| JP | 60-179190 | 9/1985 |
| JP | 60-179290 | 9/1985 |
| JP | 61-181680 | 8/1986 |
| JP | 61-291179 | 12/1986 |
| JP | 62-270383 | 11/1987 |
| JP | 1-196389 | 8/1989 |
| JP | 2-55188 | 2/1990 |
| JP | 03 047790 | 2/1991 |
| JP | 3-190786 | 8/1991 |
| JP | 3-205181 | 9/1991 |
| JP | 3-219993 | 9/1991 |
| JP | H04-164687 | 6/1992 |
| JP | 05-139033 | 6/1993 |
| JP | 5-162443 | 6/1993 |
| JP | 5-221115 | 8/1993 |
| JP | H06-155916 | 6/1994 |

(Continued)

OTHER PUBLICATIONS

European Search Report corresponding to European Patent Application No. 09725687.9-2304 dated Feb. 24, 2012.
Extended European Search Report corresponding to European Patent Application No. 08827733.0-2304 dated Jan. 27, 2012.
International Search Report corresponding to International Patent Application No. PCT/JP2007/074385 dated Feb. 14, 2008.
International Search Report corresponding to International Patent Application No. PCT/JP2008/051100 dated Apr. 15, 2008.
International Search Report corresponding to International Patent Application No. PCT/JP2008/054719 dated Sep. 22, 2008.
International Search Report corresponding to International Patent Application No. PCT/JP2008/058329 dated Jun. 9, 2008.
International Search Report corresponding to International Patent Application No. PCT/JP2008/064904 dated Oct. 7, 2008.
International Search Report corresponding to International Patent Application No. PCT/JP2009/056306 dated May 19, 2009.

(Continued)

*Primary Examiner* — Bruce H Hess
(74) *Attorney, Agent, or Firm* — Jenkins, Wilson, Taylor & Hunt, P.A.

(57) ABSTRACT

The present invention provides a thermosensitive recording medium, which has a satisfactory color developing sensitivity, an excellent general printability (surface strength) and an excellent anti-sticking property. The thermosensitive recording layer of the thermosensitive recording medium of the present invention contains an alkylketene dimer. Without forming a protecting layer, the thermosensitive recording medium of the present invention is superior in color developing sensitivity, general printability (surface strength) and anti-sticking property.

3 Claims, No Drawings

FOREIGN PATENT DOCUMENTS

| | | |
|---|---|---|
| JP | 6-234275 | 8/1994 |
| JP | 6-262853 | 9/1994 |
| JP | H06-270547 | 9/1994 |
| JP | H06-286308 | 10/1994 |
| JP | 6-340171 | 12/1994 |
| JP | 7149713 | 6/1995 |
| JP | 07-179041 | 7/1995 |
| JP | H07-266711 | 10/1995 |
| JP | 07-314896 | 12/1995 |
| JP | H08-059603 | 3/1996 |
| JP | 08-207443 | 8/1996 |
| JP | 08-324123 | 12/1996 |
| JP | H08-333329 | 12/1996 |
| JP | H09-142018 | 6/1997 |
| JP | H09-207435 | 8/1997 |
| JP | H09-263047 | 10/1997 |
| JP | H10-250232 | 9/1998 |
| JP | H10-258577 | 9/1998 |
| JP | 10-272839 | 10/1998 |
| JP | H10-297089 | 11/1998 |
| JP | H10-297090 | 11/1998 |
| JP | 10-324062 | 12/1998 |
| JP | 10-324064 | 12/1998 |
| JP | 11-314454 | 11/1999 |
| JP | 2000-143611 | 5/2000 |
| JP | 2000-168242 | 6/2000 |
| JP | 2000-177243 | 6/2000 |
| JP | 3058758 | 7/2000 |
| JP | 2000-289333 | 10/2000 |
| JP | 2001-287459 | 10/2001 |
| JP | 2001-322358 | 11/2001 |
| JP | 2001-323095 | 11/2001 |
| JP | 2002-011954 | 1/2002 |
| JP | 2002-019300 | 1/2002 |
| JP | 2002-103789 | 4/2002 |
| JP | 2002-240430 | 8/2002 |
| JP | 2002-264538 | 9/2002 |
| JP | 2002-293023 | 10/2002 |
| JP | 2002-301873 | 10/2002 |
| JP | 2002-341770 | 11/2002 |
| JP | 2003-019861 | 1/2003 |
| JP | 2003-154760 | 5/2003 |
| JP | 2003-212841 | 7/2003 |
| JP | 3439560 | 8/2003 |
| JP | 2003-313795 | 11/2003 |
| JP | 2004-202913 | 7/2004 |
| JP | 2005-001281 | 1/2005 |
| JP | 2005-041013 | 2/2005 |
| JP | 2005-134578 | 5/2005 |
| JP | 2005-154996 | 6/2005 |
| JP | 2005-199554 | 7/2005 |
| JP | 2005-220480 | 8/2005 |
| JP | 2005-262549 | 9/2005 |
| JP | 3716736 | 11/2005 |
| JP | 2006-069032 | 3/2006 |
| JP | 3750786 | 3/2006 |
| JP | 2006-095852 | 4/2006 |
| JP | 2006-168319 | 6/2006 |
| JP | 3790648 | 6/2006 |
| JP | 2006-175835 | 7/2006 |
| JP | 2006-205561 | 8/2006 |
| JP | 2006-264255 | 10/2006 |
| JP | 2006-281472 | 10/2006 |
| JP | 2007-196616 | 8/2007 |
| JP | 2007-231485 | 9/2007 |
| JP | 3971453 | 9/2007 |
| JP | 2008-012879 | 1/2008 |
| JP | 2008-018619 | 1/2008 |
| JP | 2008-044226 | 2/2008 |
| JP | 2008-044227 | 2/2008 |
| JP | 2008-105222 | 8/2008 |
| JP | 2008-194918 | 8/2008 |
| JP | 2008-248408 | 10/2008 |
| JP | 2008-248459 | 10/2008 |
| JP | 2009-012247 | 1/2009 |
| WO | WO93/06074 | 4/1993 |
| WO | WO95/33714 | 12/1995 |
| WO | WO97/16420 | 5/1997 |
| WO | WO00/14058 | 3/2000 |
| WO | WO01/25193 | 4/2001 |
| WO | WO02/081229 | 10/2002 |
| WO | WO02/098674 | 12/2002 |
| WO | WO03/029017 | 4/2003 |
| WO | WO2004/002748 | 1/2004 |
| WO | WO2005/087503 | 9/2005 |
| WO | WO2005/087504 | 9/2005 |
| WO | WO2005/102725 | 11/2005 |
| WO | WO2006/075467 | 7/2006 |
| WO | WO2007/049621 | 5/2007 |
| WO | WO2008/099658 | 8/2008 |
| WO | WO2008/126635 | 10/2008 |
| WO | WO2008/139948 | 11/2008 |
| WO | WO2009/025316 | 2/2009 |
| WO | WO2009/028118 | 3/2009 |
| WO | WO2009/119813 | 10/2009 |
| WO | WO2010/110209 | 9/2010 |
| WO | WO2010/140662 | 12/2010 |
| WO | WO2011/114780 | 9/2011 |

OTHER PUBLICATIONS

International Search Report corresponding to International Patent Application No. PCT/JP2010/054818 dated Apr. 13, 2010.

International Search Report corresponding to International Patent Application No. PCT/JP2010/059462 dated Aug. 17, 2010.

Isogai et al., "Effects of Carboxyl Groups in Pulp on Retention of Alkylketene Dimer," Journal of Pulp and Paper Science. vol. 23, No. 5 pp. J215-J219 (1997).

Japanese Industrial Standard (JIS) P-8148. Paper, board and pulps—Measurement of diffuse blue reflectance factor (ISO brightness). Japanese Standards Association (2001).

Notice of Allowance corresponding to U.S. Appl. No. 12/520,514 dated Oct. 26, 2011.

Notice of Allowance corresponding to U.S. Appl. No. 12/593,116 dated May 15, 2012.

Notice of Allowance corresponding to U.S. Appl. No. 12/599,617 dated Apr. 16, 2012.

Notification Concerning Transmittal of International Preliminary Report on Patentability (Chapter I of the Patent Cooperation Treaty) corresponding to International Patent Application No. PCT/JP2009/056306 dated Oct. 7, 2010.

Notification Concerning Transmittal of International Preliminary Report on Patentability (Chapter I of the Patent Cooperation Treaty) corresponding to International Patent Application No. PCT/JP2010/054818 dated Sep. 24, 2011.

Notification of Transmittal of Translation of the International Preliminary Report on Patentability (Chapter I or Chapter II of the Patent Cooperation Treaty) corresponding to International Patent Application No. PCT/JP2007/074385 dated Mar. 18, 2010.

Notification of Transmittal of Translation of the International Preliminary Report on Patentability (Chapter I or Chapter II of the Patent Cooperation Treaty) corresponding to International Application No. PCT/JP2008/051100 dated Aug. 27, 2009.

Notification of Transmittal of Translation of the International Preliminary Report on Patentability (Chapter I or Chapter II of the Patent Cooperation Treaty) corresponding to International Patent Application No. PCT/JP2008/054719 dated Oct. 29, 2009.

Notification of Transmittal of Translation of the International Preliminary Report on Patentability (Chapter I or Chapter II of the Patent Cooperation Treaty) corresponding to International Patent Application No. PCT/JP2008/058329 dated Jan. 21, 2010.

Notification of Transmittal of Translation of the International Preliminary Report on Patentability (Chapter I or Chapter II of the Patent Cooperation Treaty) corresponding to International Patent Application No. PCT/JP2008/064904 dated Mar. 18, 2010.

Notification of Transmittal of Translation of the International Preliminary Report on Patentability (Chapter I or Chapter II of the Patent Cooperation Treaty) corresponding to International Patent Application No. PCT/JP2009/056306 dated Nov. 18, 2010.

Notification of Transmittal of Translation of the International Preliminary Report on Patentability (Chapter I or Chapter II of the Patent Cooperation Treaty) corresponding to International Patent Application No. PCT/JP2010/054818 dated Jan. 12, 2012.

Notification of Transmittal of Translation of the International Preliminary Report on Patentability (Chapter I or Chapter II of the Patent Cooperation Treaty) corresponding to International Patent Application No. PCT/JP2010/059462 dated Dec. 15, 2011.
Official Action corresponding to U.S. Appl. No. 12/520,514 dated Mar. 10, 2010.
Official Action corresponding to U.S. Appl. No. 12/520,514 dated Oct. 27, 2010.
Official Action corresponding to U.S. Appl. No. 12/593,116 dated Feb. 1, 2012.
Supplementary European Search Report corresponding to European Patent Application No. 08703912.9-1251/2112001 dated Jan. 22, 2010.
Supplementary European Search Report corresponding to European Patent Application No. 08722115.6-1251/2130681 dated Mar. 5, 2010.
Translation, "Explanation for filing a request for early examination," filed in the corresponding JP application (2007-282831) on Feb. 10, 2009.
Translation, "Opinion," filed in the corresponding JP application (2007-282831) on Mar. 24, 2009 in response to an office action of Mar. 9, 2009.
Translation, "Test Report," filed in the corresponding JP application (2007-282831) on Feb. 10, 2009.
Extended European Search Report corresponding to European Patent Application No. 10756006.2-2304 dated Apr. 11, 2012.
International Search Report corresponding to International Patent Application No. PCT/JP2011/051714 dated Apr. 5, 2011.
Notice of Allowance corresponding to U.S. Appl. No. 12/599,617 dated Jun. 27, 2012.
Notice of Opposition corresponding to European Patent Application No. 08 752 259.5-1251/2145771 dated Jun. 14, 2012.
Notification of Transmittal of Translation of the International Preliminary Report on Patentability (Chapter I or Chapter II of the Patent Cooperation Treaty) corresponding to International Patent Application No. PCT/JP2011/051714 dated Nov. 8, 2012.
Official Action corresponding to U.S. Appl. No. 12/674,296 dated Jul. 9, 2012.
Supplemental Notice of Allowability corresponding to U.S. Appl. No. 12/599,617 dated Aug. 13, 2012.
Official Action corresponding to U.S. Appl. No. 12/674,296 dated Feb. 6, 2013.

* cited by examiner

THERMOSENSITIVE RECORDING MEDIUM

FIELD OF THE INVENTION

The present invention relates to a thermosensitive recording medium, which has a satisfactory color developing sensitivity, and is also superior in general printability (surface strength), printing run-ability, water resistance, prevention of head debris and prevention of color development during storage.

BACKGROUND OF THE INVENTION

Generally, a thermosensitive recording medium, wherein recording images are obtained by the use of color developing reaction by heat between a colorless or pale colored electron-donating leuco dye (henceforth referred to as "dye") and an electron-accepting color development agent (henceforth referred to as "color development agent"), has been widely used in the fields of facsimile, computer, various measuring instruments and the like because of the advantages in very clear color development, noiseless recording, compact and relatively inexpensive apparatus, and easy maintenance. Recently, the application of the recording medium has been rapidly expanded to output media of various printers and plotters such as handy terminals for outdoor measurement, delivery slips, in addition to labels and tickets. Therefore, the quality of the thermosensitive recording medium is required to have better developing sensitivity and better printing run-ability (prevention of sticking and head debris) than before, and furthermore to have aptitude to general printability (surface strength, ink receptivity, etc.) for offset printing. Moreover, such labels, tickets, handy terminal papers and delivery slips are used in the open air, then the recording medium should be tolerant for water, damp, sun light and high temperature to be used under sever environmental conditions. Therefore, it is required to have an advanced water resistance and a resistance for color development during storage.

To add the properties of an offset printing method, which is a different printing method from a thermosensitive recording method, to a thermosensitive recording medium, several thermosensitive recording media have been developed, such as a thermosensitive recording medium containing fluorine-based resin in the thermosensitive recording layer (Reference 1), a thermosensitive recording medium containing pigments having a certain mean particle diameter, specific surface area, and fine pore volume in a thermosensitive recording layer (Reference 2), and a thermosensitive recording medium containing pigments with certain oil absorption and emulsion of hydrophobic resin in a thermosensitive recording layer (Reference 3).

Still furthermore, a technique of adding acrylate resins in a thermosensitive recording layer has been developed to improve water resistance, and a technique of using simultaneously acrylate polymer, acrylate emulsion resins and colloidal silica in a thermosensitive recording layer has been developed to improve water resistance and head debris resistance (References 4 and 5).

Additionally, an alkylketene dimer used in the present invention has been used as a neutral sizing agent and it is well known that an alkylketene dimer produces a sizing effect by binding to a cellulose at a paper making process (Reference 6 etc.).

Reference 1: Japanese Patent Application Public Disclosure H09-142018

Reference 2: Japanese Patent Application Public Disclosure 2005-199554

Reference 3: Japanese Patent Application Public Disclosure H10-250232

Reference 4: Japanese Patent Application Public Disclosure H09-207435

Reference 5: Japanese Patent Application Public Disclosure H07-266711

Reference 6: Japanese Patent No. 3755483

Problems to be Solved by the Invention

However, when a thermosensitive recording layer contains fluorine-based resins with a high oil resistance (Reference 1), the thermosensitive recording medium can not attain a satisfactory general printability (especially ink receptivity), and the thermosensitive recording medium containing pigments as described in Reference 2 can not have a satisfactory general printability (surface strength). And, when a thermosensitive recording layer contains hydrophobic resin emulsions (Reference 3), the thermosensitive recording medium has a problem in printing run-ability (especially in anti-sticking property).

Additionally, when a thermosensitive recording layer or its protecting layer contains an acrylate resin, the recording medium has a problem that head debris are produced since acrylate resins are softened by being heated by a thermal head of a thermosensitive recording printer, although the water resistance may be improved. In order to solve this problem of head debris and to improve water resistance, a conventional thermosensitive recording medium was developed by introducing an acrylate resin and a colloidal silica in a thermosensitive recording layer (References 4 and 5), but this thermosensitive recording medium also had a problem that a blank part becomes colored based on the reaction between dyes and color development agents contained in the thermosensitive recording layer during storage due to the effect of activity that a colloidal silica itself has.

Therefore, it is an object of the present invention to provide a thermosensitive recording medium, which has a satisfactory color developing sensitivity, and is also superior in general printability (surface strength), printing run-ability, water resistance, prevention of head debris, and prevention of color development during storage.

Means to Solve the Problems

The present inventors discovered that the problems above could be solved by introducing an alkylketene dimer as a sizing agent to a thermosensitive recording layer containing dyes and color development agents placed on a substrate of a thermosensitive recording medium, and accomplished the present invention.

More specifically, the present invention is a thermosensitive recording medium having a thermosensitive recording layer containing colorless or pale colored electron-donating leuco dye and electron-accepting color development agent on a substrate, wherein the thermosensitive recording layer comprises an alkylketene dimer.

Furthermore, the present invention is the thermosensitive recording medium, wherein the thermosensitive recording layer further comprises an acrylate resin as a binder.

Advantage of the Invention

The thermosensitive recording medium of the present invention has a thermosensitive recording layer containing an alkylketene dimer (AKD), therefore the thermosensitive recording medium has an excellent color developing sensitivity, surface strength, printing run ability (prevention of head debris), water blocking resistance, and blank part preservation property. And when the thermosensitive recording layer further contains an acrylate resin, an excellent water blocking resistance is imparted. Particularly, the thermosensitive recording medium shows an excellency in these properties without installing a protecting layer.

DETAILED DESCRIPTION OF THE INVENTION

A thermosensitive recording layer of the thermosensitive recording medium of the present invention contains an alkylketene dimer.

The alkylketene dimer used in the present invention has a structure of the chemical formula below:

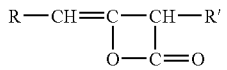

wherein:

R and R', which may be identical to or different from the other, are hydrocarbon groups having about 8 to about 30 carbon atoms, which are usually alkyl groups.

When a thermosensitive recording layer is printed by offset method, there may be generated a phenomenon called "wet pick", wherein the thermosensitive recording layer is transferred to the printing plate, because the thermosensitive recording layer is swollen and damped down by an effect of a dampening water. However, the thermosensitive recording medium with a thermosensitive recording layer containing an alkylketene dimer of the present invention does not generate wet pick and shows an excellent general printability. This mechanism is explained as follows:

Since the alkylketene dimer in a thermosensitive recording layer is easily recrystallized, the elution of the alkylketene dimer by instantaneous heat from a thermal head is suppressed and the printing run-ability (anti-sticking property) becomes better.

Furthermore, since the melting temperature of alkylketene dimer is about at 50° C. and the alkylketene dimer has a good fluidity during the operation (drying process) of thermosensitive recording medium, where the temperature on the paper is controlled below 70° C., the alkylketene dimer is distributed uniformly in the thermosensitive recording layer, which makes the whole thermosensitive recording layer hydrophobic.

In this way, it will suppress the effect of dampening water during offset printing without hampering the printing run-ability (anti-sticking property) that an alkylketene dimer is contained in a thermosensitive recording layer. Moreover, an alkylketene dimer provides an excellent ink receptivity due to its lipophilicity, Additionally, since an alkylketene dimer provides above-mentioned properties to a thermosensitive recording layer, the thermosensitive recording medium has a satisfactory film strength and a printing run-ability (anti-sticking property), even if a protecting layer is not installed on the thermosensitive recording layer.

The alkylketene dimer of the present invention is used generally as an emulsion, wherein alkylketene dimer is emulsified by the use of starch, synthetic polymer, surfactant etc. and is dispersed in water. The alkylketene dimer includes generally, but is not limited to, the commercialized products of DIC Hercules Chemical Inc., Arakawa Chemical Industries Ltd., Harima Chemicals, Inc, BASF Japan Ltd., Kao Corporation etc. as a neutral sizing agent (for internal and external additive).

The content of alkylketene dimer used in the present invention is preferably between 0.1 and 5 parts by weight, more preferably between 0.5 and 2 parts per weight (henceforth part per weight is indicated by dry solid content) relative to 100 parts per total solid weight of a thermosensitive recording layer. When the content of alkylketene dimer is less than 0.1 parts per weight, a satisfactory general printability (surface strength) cannot provided. When the content is more than 5 parts per weight, a high color developing sensitivity cannot be attained and the viscosity of the coating solution is increased.

The thermosensitive recording layer of the present invention further includes a color development agent and a dye, and may include sensitizers, binders, cross-linking agents, image stabilizers, pigments, lubricants etc.

Color development agents used in the present invention include, but are not particularly limited to, all well-known agents in the field of conventional pressure-sensitive and thermosensitive recording paper; e.g. 4,4'-isopropylidene diphenol, 1,1-bis(4-hydroxyphenyl)cyclohexane, 2,2-bis(4-hydroxyphenyl)-4-methylpentane, 4,4'-dihydroxydiphenyl sulfide, hydroquinone monobenzyl ether, 4-hydroxybenzylbenzoate, 4,4'-dihydroxy diphenyl sulfone, 2,4'-dihydroxy diphenyl sulfone, 4-hydroxy-4'-isopropoxy diphenyl sulfone, 4-hydroxy-4'-n-propoxy diphenyl sulfone, bis(3-allyl-4-hydroxyphenyl) sulfone, 4-hydroxy-4'-allyloxy diphenyl sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, aminobenzene sulfonamide derivatives described in Japanese Patent Application Public Disclosure No. H08-59603, bis(4-hydroxyphenyl thioethoxy)methane, 1,5-di(4-hydroxyphenyl thio)-3-oxapentane, butyl bis(p-hydroxyphenyl)acetate, methyl bis(p-hydroxyphenyl)acetate, 1,1-bis(4-hydroxyphenyl)-1-phenyl ethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, developing composition described in International Publication WO02/098674, compounds described in International Publication WO02/081229 or Japanese Patent Application Public Disclosure No. 2002-301873, 4,4'-bis[3-(phenoxycarbonylamino) methylphenylureido]diphenylsulfone (Asahikasei corporation UU), thiourea compounds such as N,N'-di-m-chlorophenyl thiourea and the like, p-chlorobenzoic acid, stearyl gallate, bis[zinc 4-(n-octyloxy carbonylamino)salicylate]dihydrate, 4-[2-(p-methoxyphenoxy)ethyloxy]salicylic acid, 4[3-(p-tolylsulfonyl) propyloxy]salicylic acid, aromatic carboxylic acids such as 5-[p-(2-p-methoxyphenoxyethoxy) cumyl]salicylic acid and salts of these aromatic carboxylic acids and polyvalent metals such as zinc, magnesium, aluminum, calcium, titanium, manganese, tin, nickel and the like, and, furthermore, antipyrine complexes of zinc thiocyanate and complex zinc salts and the like of terephthalaldehyde acid with other aromatic carboxylic acids. The phenolic compound such as diphenylsulfone crosslinked type compound and the like described in International Publication WO97/16420 is available under the trade name of D-90 produced by Japan Soda K.K. The compound described in International Publication WO02/081229 or Japanese Patent Application Public Disclosure No. 2002-301873 is also available under the trade names of D-102 and D-100 produced by Nippon Soda Co., Ltd. These color development agents may be used individually or as mixtures of at least two of them. Among them, 4-hydroxy-4'-isopropoxy diphenyl sulfone is preferably used because of the excellent developing sensitivity of the compound. Additionally, higher fatty acid metal complex salts described in Japanese Patent Application Public Disclosure No. H10-258577 and metal chelate type color development components such as polyvalent hydroxyl aromatic compounds and the like may also be included.

All of the dyes well known in the conventional field of pressure-sensitive and thermosensitive recording media can be used as dyes of the present invention. Although the dye is not particularly limited to, triphenylmethane type compounds, fluorane type compounds, fluorene type compounds, divinyl type compounds and the like are preferred. Specific examples of the typical colorless to pale colored basic colorless dye (dye precursors) are shown below. In addition, these dye precursors may be used individually and also in mixtures of at least two of them.

Triphenylmethane type leuco dyes>

3,3-bis(p-dimethyl aminophenyl)-6-dimethylaminophthalide [alternate name: crystal violet lactone] and 3,3-bis(p-dimethyl aminophenyl) phthalide [alternate name: malachite green lactone]

Fluorane type leuco dyes>

3-diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p-chloroanilino) fluorane, 3-diethylamino-6-methyl-7-(o-fluoroanilino) fluorane, 3-diethylamino-6-methyl-7-(m-methylanilino) fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane, 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloroanilino) fluorane, 3-diethylamino-7-(p-chloroanilino) fluorane, 3-diethylamino-7-(o-fluoroanilino) fluorane, 3-diethylamino-benzo[a]fluorane, 3-diethylamino-benzo[c]fluorane, 3-dibutylamino-6-methyl-fluorane, 3-dibutylamino-6-methyl-7-anilino fluorane, 3-dibutylamino-6-methyl-7-(o,p-dimethylanilino) fluorane, 3-dibutylamino-6-methyl-7-(o-chloroanilino) fluorane, 3-dibutylamino-6-methyl-7-(p-chloroanilino) fluorane, 3-dibutylamino-6-methyl-7-(o-fluoroanilino) fluorane, 3-dibutylamino-6-methyl-7-(m-trifluoromethylanilino) fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7(o-chloroanilino) fluorane, 3-dibutylamino-7-(o-fluoroanilino) fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino) fluorane, 3-di-n-pentylamino-6-chloro-7-anilino fluorane, 3-di-n-pentylamino-7-(p-chloroanilino) fluorane, 3-pyrrolidino-6-methyl-7-anilino fluorane, 3-piperidino-6-methyl-7-anilino fluorane, 34N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylamino)-6-methyl-7-(p-chloroanilino) fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-p-(p-dimethylaminophenyl)aminoanilino fluorane, 2-methoxy-6-p-(p-dimethylaminophenyl)aminoanilino fluorane, 2-chloro-3-methyl-6-p-(p-phenylaminophenyl) aminoanilino fluorane, 2-chloro-6-p-(p-dimethylaminophenyl)aminoanilino fluorane, 2-nitro-6-p-(p-diethylaminophenyl)aminoanilino fluorane, 2-amino-6-p-(p-diethylaminophenyl)aminoanilino fluorane, 2-diethylamino-6-p-(p-diethylaminophenyl)aminoanilino fluorane, 2-phenyl-6-methyl-6-p-(p-phenylaminophenyl)aminoanilino fluorane, 2-benzyl-6-p-(p-phenylaminophenyl)aminoanilino fluorane, 2-hydroxy-6-p-(p-phenylaminophenyl) aminoanilino fluorane, 3-methyl-6-p-(p-dimethylaminophenyl)aminoanilino fluorane, 3-diethylamino-6-p-(p-diethylaminophenyl)aminoanilino fluorane, 3-diethylamino-6-p-(p-dibutylaminophenyl)aminoanilino fluorane and 2,4-dimethyl-6-[(4-dimethylamino) anilino]fluorane.

Fluorene type leuco dye 3,6,6'-tris(dimethylamino) spiro[fluorene-9,3'-phthalide] and 3,6,6'-tris(diethylamino) spiro[fluorene-9,3'-phthalide].

Divinyl type leuco dyes 3,3-bis-[2-(p-dimethyl aminophenyl)-2-(p-methoxyphenyl)ethenyl]-4,5,6,7-tetrabromophthalide, 3,3-bis-[2-(p-dimethylaminophenyl)-2-(p-methoxyphenyl)ethenyl]-4,5,6,7-tetrachlorophthalide, 3,3-bis-[1,1-bis(4-pyrrolidinophenyl)ethylene-2-yl]-4,5,6,7-tetrabromophthalide and 3,3-bis-[1-(4-methoxyphenyl)-1-(4-pyrolydinophenyl)ethylene-2-yl]-4,5,6,7-tetrachlorophthalide.

<Others>

3-(4-diethylamino-2-ethoxyphenyl)-3-(1-ethyl-2-methylindol-3-O-4-azaphthalide, 3-(4-diethylamino-2-ethoxyphenyl)-3-(1-octyl-2-methylindol-3-O-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitro)anilinolactam, 3,8-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2",2"-tetrakis-(p-dimethylaminophenyl)-ethenyl]-2-8-naphthoylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

In the present invention, it is preferable that the thermosensitive recording layer containing alkylketene dimer as a sizing agent also contains acrylate resins as binders.

Acrylate resins are emulsified polymers prepared by copolymerization mainly of acrylic acid, metacrylic acid, derivatives of acrylic acid and metacrylic acid (acrylamide, acrylnitrile and the like), maleic acid and its derivatives, and styrene and its derivatives and the like. There are no restrictions on the composition ratio of monomers and the synthetic methods. However, the thermosensitive recording layer preferably contains core-shell type styrene-acrylate resins in terms of water resistance and head debris resistance. Furthermore, there are no restrictions on the glass transition temperature (Tg) and minimum film forming temperature (MFT) for acrylate resins. However, the glass transition temperature (Tg) is preferably equal to or less than 50° C., more preferably between 0 and 50° C., and most preferably between 15 and 40° C. And the minimum film forming temperature (MFT) is preferably equal to or less than 25° C., more preferably between 0 and 25° C., and most preferably between 5 and 15° C.

Generally, the acrylate resins have the molecular weight of more than about 100,000 and are used in an emulsified state. The acrylate resins used as binders can be distinguished from the acrylate resins used as sizing agents, which has a molecular weight between about 1000 and about 100,000 and are used in a from of aqueous solution with addition of hydrophilic groups.

In the manufacturing process of a thermosensitive recording medium, the temperature is controlled not to exceed 60° C. to prevent the color development. Therefore, in order to improve water resistance, it is preferable to use resins with low minimum film forming temperature (MFT), wherein a film is adequately formed at about 60° C. However, head debris and sticking may be generated due to softening of resins by heat from a thermal head of a themosensitive recording printer when a thermosensitive recording layer contains resins with low minimum film forming temperature (MFT), i.e. resins with low glass transition temperature (Tg), since generally minimum film forming temperature (MFT) correlates to glass transition temperature (Tg). Therefore, a conventional technique has been used to obtain an excellent water resistance and a prevention of head debris based on the control of apparent glass transition temperature (Tg) and minimum film forming temperature (MFT) of acrylate resins by mixing acrylate resins with low minimum film forming temperature (MFT) with colloidal silica, in other words, by adhering colloidal silica to the surface of acrylate resins. However, there arises a new problem that blank part becomes colored during storage due to the reaction of dyes with color development agent contained in the thermosensitive recording layer base on the effect of activity of colloidal silica. Therefore, conventionally, it was difficult to obtain a thermosensitive recording medium, which is excellent in water resistance, head debris resistance and prevention of color development during storage by using acrylate resins with glass transition temperature (Tg) of less than 50° C. and minimum film forming temperature (MFT) of less than 25° C.

However, when a thermosensitive recording layer contains acrylate resins and alkylketene dimer in combination, it becomes possible to include acrylate resins with low Tg and low MFT in a thermosensitive recording layer, which can impart a high water resistance, but used to cause problems in head debris.

Additionally, the glass transition temperature (Tg) of a resin depends on the individual glass transition temperature of components (i.e. monomers) composing the resin. Tg of each monomer is defined by the temperature with a change of specific heat of a sample accompanied with the second-order transition measured by differential scanning calorimetry (temperature rise of a 10 mg sample with 25° C./min under nitrogen atmosphere). Thus, Tg of a resin is obtained by the following calculation formula according to Japanese Industrial Standards (JIS) K-7122

$$\text{Glass transition temperature } (Tg) \text{ of a resin} = Tg_1 \times \alpha_1 + Tg_2 \times \alpha_2 + + Tg_n \times \alpha_n,$$

wherein:

$Tg_1$, $Tg_2$, or $Tg_n$ is a glass transition temperature measured for each monomer; and $\alpha_1$, $\alpha_2$, or $\alpha_n$ is a weight fraction of each monomer relative to the total weight of the resin.

Furthermore, the minimum film forming temperature (MFT) is measures as in the following manner according to JIS K-6828. An emulsion of a resin prepared as 20 weight % based on is spread homogeneously on a slide glass and dried at a certain temperature. MFT is defined as the lowest temperature wherein the surface of the dried resin is continuous and homogeneous film without having a white turbidity.

In the present invention, core-shell type acrylate resins are exemplified as core-shell type emulsion, wherein acrylate, styrene acrylate or styrene methacrylate resins is used for core part and styrene acrylate or styrene methacrylate resins is used for shell part; i.e. Joncryl 74J, Joncryl 537, PDX7677 (all above from BASF Japan Co.) etc. Among them, core-shell type acrylate resins with glass transition temperature (Tg) of less than 50° C. and minimum film forming temperature (MFT) of less than 25° C. include Joncryl 74J, PDX7677 (all above from BASF Japan Co.) etc.

On the other hand, non core-shell type acrylate resins include Movinyl 718, Movinyl 735, Movinyl 8020, Movinyl 8030, Movinyl 9000 (all above from Kurariant Polymer Company), SA-532 (Nippon Shokubai Co., Ltd.) etc.

The content of acrylate resins used in the present invention is preferably between 1 and 30 weight % (henceforth "parts by weight" is indicated by solid content), and more preferably between 2 and 10 weight % relative to total solid content of the thermosensitive recording layer. When the content of acrylate resins is less than 1 weight %, an excellent water resistance cannot be attained and when the content is more than 30 weight %, a high color developing sensitivity cannot be attained.

Moreover, binders used in the present invention can use any compounds well-known in the arts. Specifically, the binders can be exemplified by fully saponified polyvinyl alcohol; partially saponified polyvinyl alcohol; carboxylated polyvinyl alcohol; amidated polyvinyl alcohol; sulfonated polyvinyl alcohol; butyralated polyvinyl alcohol; other denatured polyvinyl alcohol; cellulose derivatives such as, hydroxy ethyl cellulose, methyl cellulose, carboxy methyl cellulose, ethyl cellulose, acethyl cellulose; styrene-maleic anhydride copolymer; styrene-butadiene copolymer; poly-vinyl chloride; poly-vinyl acetate, poly-acryl amide, poly-acrylate, polyvinyl butyral, polystyrene and its copolymers; polyamide resin; silicon resin, petroleum resin; terpene resin; ketone resin and coumarone resin.

These polymer materials may be used as solution in water, alcohol, ketone, ester, or hydrocarbons etc., as dispersed state by emulsification or pastelization in water or in other vehicles, or as combination of the above two depending on the required quality, The content of a binder is preferably between 1 and 30 weight % relative to total solid part of thermosensitive layer. When the content of a binder is less than 1 weight %, water resistance and surface strength are inferior, and when the content is more than 30 weight %, high color developing sensitivity cannot be attained.

The thermosensitive recording layer of the present invention can use conventional crosslinking agents well known in the arts, as long as they do not interfere with the required effect on an objective of the present invention. Such crosslinking agents are exemplified by glyoxal, methylolmelamine, melamine formaldehyde resin, melamine urea resin, polyamine epichlorohydrin resin, polyamide epichlorohydrin resin, potassium persulfate, ammonium persulfate, sodium persulfate, ferric chloride, magnesium chloride, borax, boric acid, alum, ammonium chloride etc.

The thermosensitive recording layer of the present invention can use conventional lubricants well known in the arts, as long as they do not interfere with the required effect on an objective of the present invention. Such lubricants are exemplified by metal salts of fatty acids such as zinc stearate, calcium stearate; wax; and silicon resins. Furthermore, UV absorption agents of benzophenons and triazoles, dispersing agents, antiform agents, antioxidants, and fluorescent dyes may be used.

The thermosensitive recording layer of the present invention can use conventional sensitizers well known in the arts, as long as they do not interfere with the required effect on an objective of the present invention. Such sensitizers are exemplified by ethylene bis-amide, montan acid wax, polyethylene wax, 1,2-di-(3-methylphenoxy)ethane, p-benzyl biphenyl, β-benzyloxy naphthalene, 4-biphenyl-p-tolyl ether, m-terphenyl, 1,2-diphenoxyethane, 4,4'-ethylenedioxi-bis-dibenzyl benzoate, dibenzoyl oxymethane, 1,2-di(3-methyl phenoxy)ethylene, 1,2-diphenoxyethylene, bis[2-(4-methoxyphenoxy)ethyl]ether, p-nitro methyl benzoate, dibenzyl oxalate, di(p-chlorobenzyl) oxalate, di(p-methylbenzyl) oxalate, dibenzyl terephthalate, benzyl p-benzyloxy benzoate, di-p-tolyl carbonate, phenyl-α-naphthyl carbonate, 1,4-diethoxynaphthalene, 1-hydroxy-2-phenyl naphthoate, 4-(m-methyl phenoxymethyl) biphenyl, o-toluene sulfonamide, p-toluene sulfonamide, but are not limited by the above examples. These sensitizers may be used individually, or as a mixture of at least two of them.

Filler used in the present invention include inorganic or organic fillers such as silica, calcium carbonate, kaoline, calcined kaoline, diatomaceous earth, talc, titanium oxide, aluminum hydroxide etc. These fillers may be used individually, or as a mixture of at least two of them. Simultaneous use of calcium carbonate and silica is preferable from the points of strength of coating layer and printing run-ability. Moreover, it is preferable to use simultaneously calcium carbonate with mean diameter of equal to or more than 3 μm and silica with mean diameter between 5 and 10 μm, oil absorption of equal to or more than 150 ml/100 g and specific surface area of equal to or less than 150 $m^2/g$. Additionally, for use of calcium carbonate and silica, calcium carbonate/silica weight ratio is preferably between 20/80 and 80/20, and more preferably between 40/60 and 60/40. Still furthermore, between 0.5 and 10 parts by weight relative to 1 part by weight of basic leuco dye is preferable.

The thermosensitive recording layer of the present invention can include stabilizers to provide recording images with oil resistance, as long as they do not interfere with the required effect on an objective of the present invention. Such stabilizers include 4,4'-butylidene (6-t-butyl-3-methylphenol), 1,1,3-tris(2-methyl-4-hydroxy-5-cyclohexylphenyl) butane, 1,1,3-tris (2-methyl-4-hydroxy-5-t-butylphenyl) butane, 4-benzyloxy-4'-(2,3-epoxy-2-methylpropoxy) diphenyl sulfone, epoxy resin etc.

Types and the amount of dyes, color development agents and other components used for the thermosensitive recording medium of the present invention are determined according to the performance required and recording ability. The amount of color development agents between 0.5 and 10 parts by weight, that of sensitizers between 0.5 and 10 parts by weight and that of filler between 0.5 and 10 parts by weight relative to 1 part by weight of a basic leuco dye are generally used, although these amounts are not particularly limited to use.

A objective thermosensitive recording medium will be obtained by coating the above coating liquid on an any substrate, such as paper, recycled paper, synthetic paper, film, plastic film, foamed plastic film and unwoven fabric. A combined sheet prepared by the combination above sheets may also be used as a support. Basic leuco dyes, color development agents and additives, used if necessary, are ground with particle diameter of equal to or less than several microns by a grind mill, such as ball mill, attritor or sand grinder; or by an appropriate phacoemulsifier; and are added with binder or various additives depending on the purpose to prepare coating liquid. The method for coating is not particularly limited to and includes conventional techniques well known in the arts. For example, off or on machine coater with various coating applications, such as air knife coater, rod blade coater, bill blade coater, roll coater, curtain coater, and spray coater is appropriately chosen and used. The amount of coating is not particularly limited, and is generally in the range of between 2 and 12 $g/m^2$ in dry weight.

The thermosensitive recording medium of the present invention does not exclude installing a protecting layer on a thermosensitive recording layer. The protecting layer usually contains pigments and resins as main components. The resin includes, for example, water soluble polymers such as polyvinyl alcohol and starch. It is particularly preferable that the protecting layer contains resins with carboxyl group (e.g., carboxylated polyvinyl alcohol), epichlorohydrin resins and modified polyamine/amide resins from the view point of heat resistance, water resistance and moist heat resistance.

Moreover, to enhance the color developing sensitivity of the thermosensitive recording medium of the present invention, an undercoat layer of polymer material and the like containing fillers may be placed under a thermosensitive recording layer. It is also possible to place a back coat layer on the back of the substrate relative to a thermosensitive recording layer for correcting curl. Additionally, it is possible to add optionally a conventional technique well-known in the field of thermosensitive recording medium; e.g., smoothing by supercalendering and the like after coating of each layer.

EXAMPLES

The following examples illustrate the present invention, but these are not intended to restrict the present invention. "Part" used in the following examples shows "part by weight" unless it is specified.

Example 1

Undercoating liquid is prepared by stirring and dispersion of the following composition.

<Undercoating Liquid>

| | |
|---|---|
| Calcined kaoline (Engelhard Corporation, Ansilex90) | 100 parts |
| Styrene-butadiene copolymer latex (dry solid content 48%) | 40 parts |
| 10% Aqueous solution of complete saponificated polyvinyl alcohol (Kuraray Co. Ltd., PVA117) | 30 parts |
| Water | 160 parts |

Then, one side of a substrate (free paper with basic weight 50 $g/m^2$) was coated with the undercoating liquid until the coating amount is 8.0 $g/m^2$, and was dried to prepare an under-coated paper.

For the preparation of dye, color development agent and sensitizer, dispersion liquid of each material with the following composition was prepared. Each dispersion liquid was ground with sand grinder by a wet process until mean diameter became 0.5 μm. The grain diameter was measured by the use of laser diffraction particle size analyzer (Malvern Instruments Ltd., Mastersizer S).

<Dispersion Liquid for a Color Development Agent>

| | |
|---|---|
| 4-hydroxy-4'-isopropoxy diphenyl sulfone (API Corporation) | 6.0 parts |
| 10% Aqueous solution of polyvinyl alcohol (Nippon Synthetic Chemical Industry Co., Ltd. GL-3, D.P.: 300, Degree of saponification: 88 mol %) | 18.8 parts |
| Water | 11.2 parts |

<Dispersion Liquid for a Dye>

| | |
|---|---|
| 3-di-n-butylamino-6-methyl-7-anilinofluorane (Yamada Chemical Co., Ltd., ODB-2) | 3.0 parts |
| 10% Aqueous solution of polyvinyl alcohol (GL-3) | 6.9 parts |
| Water | 3.9 parts |

<Dispersion Liquid for a Sensitizer>

| | |
|---|---|
| 1,2-di-(3-methylphenoxy) ethane (Sanko Co., Ltd., KS232) | 6.0 parts |
| 10% Aqueous solution of polyvinyl alcohol (GL-3) | 18.8 parts |
| Water | 11.2 parts |

A thermosensitive recording layer coating liquid was prepared by mixing the above dispersion liquid in the following proportion:

| | |
|---|---|
| Dispersion liquid for a color development agent | 36.0 parts |
| Dispersion liquid for a dye | 13.8 parts |
| Dispersion liquid for a sensitizer | 36.0 parts |
| 50% Dispersion liquid for silica (CARPLEX101, Mean particle diameter: 7 μm, Oil absorbance: 178 ml/100 g, BET specific surface area: 65 $m^2$/g, DSL Japan Co., Ltd.) | 13.0 parts |
| 50% Dispersion liquid for calcium carbonate (Tunex E, Mean particle diameter: 4.4 μm, Shiraishi Calcium Kaisha, Ltd.) | 13.0 parts |
| 30% Dispersion liquid for zinc stearate | 6.7 parts |
| 10% Aqueous solution of partially saponified polyvinyl alcohol (Kurarey Co., Ltd., PVA217, D.P.: 1750, Degree of saponification: 88 mol %) | 20 parts |
| Alkylketene dimer (Seiko PMC Co., AD1604, Solid content: 30%, Internal sizing agent) | 1.4 parts |

The under-coated paper was coated with the above coating liquid at 6.0 g/$m^2$ (dry weight), dried, and calendared by super calendar to Bekk smoothness between 200 and 600 sec to prepare a thermosensitive recording medium.

Example 2

A thermosensitive recording medium was prepared using similar procedures as Example 1 except changing 1.4 parts of alkylketene dimer to 2.1 parts of alkylketene dimer (Seiko PMC Co., SE2360, Solid content: 20%, Surface sizing agent), Example 3

A thermosensitive recording medium was prepared by the use of similar procedures as Example 1 except changing the blending quantity of the alkylketene dimer to 0.7 parts.

Example 4

A thermosensitive recording medium was prepared by the use of similar procedures as Example 1 except changing the blending quantity of the alkylketene dimer to 2.0 parts.

Comparative Example 1

A thermosensitive recording medium was prepared by the use of similar procedures as Example 1 except the use of the alkylketene dimer.

Comparative Example 2

A thermosensitive recording medium was prepared by the use of similar procedures as Example 1 except the use of 0.8 parts of denatured rosin emulsion (Seiko PMC Co., CC 1404, Solid content: 50%) instead of 1.4 parts of alkylketene dimer.

Comparative Example 3

A thermosensitive recording medium was prepared by the use of similar procedures as Example 1 except the use of 1.4 parts of styrene-acrylate surface sizing agent (Seiko PMC Co., SE2064, Solid content: 30%) instead of 1.4 parts of alkylketene dimer.

Comparative Example 4

A thermosensitive recording medium was prepared by the use of similar procedures as Example 1 except the use of 1.7 parts of acrylate surface sizing agent (Seiko PMC SE2560, Solid content: 25%) instead of 1.4 parts of alkylketene dimer.

Comparative Example 5

A thermosensitive recording medium was prepared by the use of similar procedures as Example 1 except the use of 1.4 parts of acrylate-olefin surface sizing agent (Seiko PMC Co., SE2647, Solid content: 30%) instead of 1.4 parts of alkylketene dimer.

Example 5

Thermosensitive recording layer coating liquid 2 was prepared by mixing the dispersion liquid for a color development agent, dye and sensitizer obtained in Example 1 in the following proportion:

| | |
|---|---|
| Dispersion liquid for a color development agent of Example 1 | 36.0 parts |
| Dispersion liquid for a dye of Example 1 | 13.8 parts |
| Dispersion liquid for a sensitizer of Example 1 | 36.0 parts |
| 25% Dispersion liquid for silica (Mizusawa Industrial Chemicals Ltd., P537) | 26 parts |
| 50% Dispersion liquid for clalcium carbonate (Shiraishi Calcium Kaisha, Ltd., Tunex E, Mean particle diameter: 4.4 μm) | 13.0 parts |
| 30% Dispersion liquid for zinc stearate (Chukyo Yushi. Ltd., Hydrin Z-7-30) | 6.7 parts |
| 10% Aqueous solution of polyviny alcohol (Kurarey Co., Ltd., PVA217, D.P.: 1750, Degree of saponification: 88 mol %) | 20.0 parts |
| Styrene-acrylate resin (BASF Japan Co., Joncryl 74J, solid content: 45%, Glass transition temperature: 22° C., Minimum film forming temperature: 5° C.) | 10.0 parts |
| Alkylketene dimer (Seiko PMC Co., AD1604, Solid content: 30%) | 1.4 parts. |

The under-coated paper obtained in Example 1 was coated with the coating liquid at 6.0 g/$m^2$ (dry weight), dried, calendared by super calendar to Beck smoothness between 200 and 600 sec to prepare the thermosensitive recording medium 2.

Example 6

A thermosensitive recording medium was prepared by the use of similar procedures as Example 5 except changing styrene-acrylate resin to non core-shell type acrylate resin (Kurariant Polymer Company, Movinyl 735, Solid content: 43%, Glass transition temperature: 14° C., Minimum film forming temperature: 25° C.).

Example 7

A thermosensitive recording medium was prepared by the use of similar procedures as Example 5 except changing the blending quantity of alkylketene dimer to 4.2 parts.

Example 8

A thermosensitive recording medium was prepared by the use of similar procedures as Example 5 except changing the blending quantity of alkylketene dimer to 0.16 parts.

Example 9

A thermosensitive recording medium was prepared by the use of similar procedures as Example 1 except adding 15 parts of styrene-acrylate resin (BASF Japan Co., Joncryl 74J) instead of 20 parts of aqueous solution of partially saponified polyvinyl alcohol (PVA217) of the thermosensitive recording layer coating liquid.

Comparative Example 6

A thermosensitive recording medium was prepared by the use of similar procedures as Example 5 except changing styrene-acrylate resin to fully saponified polyvinyl alcohol (Kurarey Co., Ltd., PVA117, D.P.: 1750, Degree of saponification: 98 mol % and not using alkylketene dimer.

Comparative Example 7

A thermosensitive recording medium was prepared by the use of similar procedures as Example 5, except the use of alkylketene dimer.

Comparative Example 8

A thermosensitive recording medium was prepared by the use of similar procedures as Example 5, except changing styrene-acrylate resin to 5 parts of acrylate resin (Kurariant Polymer Company, Movinyl 9000, Solid content: 40%) and spherical colloidal silica (Kurariant Japan K.K., KLEBOSOL 40R12, Solid content: 40%), and not using alkylketene dimer.

Comparative Example 9

A thermosensitive recording medium was prepared by the use of similar procedures as Example 5, except changing alkylketene dimer to 1.8 parts of polyamide epichlorohydrin resin (Seiko PMC Co., WS4020, Solid content: 25%).

The thermosensitive recording media prepared in the above Examples and Comparative Examples were evaluated as in the following way.

[Color Developing Sensitivity]

Printing was performed by the use of TH-PMD (Ohkura Electric Co., Ltd.), wherein the thermosensitive recording medium was printed at applied energy of 0.34 mJ/dot and 0.25 mJ/dot. Image density was measured by Machbeth Desnsitometer (RD-914, with an amber filter) after printing and quality test.

[Surface Strength]

One surface of the thermosensitive recording layer was printed by using Pruefbau printing machine (printing rate: 100 m/min) with 0.25 ml of sheet-fed ink (Toyo Ink, TK hiunityMZ indigo, Printing unit pressure: 50 kgf) and 0.015 ml of dampening water (dampening water unit pressure: 20 kgf), then the ink fixability was checked. As for the thermosensitive recording media of Examples 1 to 4 and Comparative Examples 1 to 5, ink removal was evaluated by visual judgment on the basis of following criteria.

Excellent: No ink removal

Good: Almost no ink removal

Poor: A lot of ink removal

Also, as for the thermosensitive recording media of Example 5 to 8 and Comparative Example 6 to 9, peeling of coating layer was evaluated by visual judgment on the basis of the following criteria.

Good: No peeling of coating layer

Fair: Almost no peeling of coating layer

Poor: A lot of peeling of coating layer.

[Printing Run-Ability]

As for Examples 1 to 4 and Comparative Examples 1 to 5, printing was performed at −5° C. with Ishida thermal label printer (IP21EX) and ink removal of solidity printed area was evaluated visually with the following criteria:

Excellent: No unprinted area in recorded surface

Good: Almost no unprinted area in recorded surface

Fair: Some unprinted area in recorded surface

Poor: Much unprinted area in recorded surface

Also, as for Examples 5 to 8 and Comparative Examples 6 to 9, printing of about 30 cm grid was performed with a label printer from Sato Corporation (Printer name: L' esprit R-8). Head debris stuck to a thermal head and printed sample after printing were evaluated visually with the following criteria:

Good: Almost no head debris stuck to a thermal head

Fair: Some head debris stuck to a thermal head, but no grazed printed area

Poor: Sticking of head debris to a thermal head and grazed printed area.

[Water Resistance (Water Blocking Resistance)]

Water droplet (50 μl) was dropped on a surface of a thermosensitive recording medium, then the recording surface was folded inward. Then the recording medium dropped with water droplet was pressed with 10 g/cm$^2$ load and left for 24 hr under the condition of 23° C. and 50% Rh. After that, the recording surface was peeled, heated at 105° C. for 2 min, and the degree of peeling of the recording surface was evaluated by visual judgment on the basis of the following criteria.

Excellent: No peeling of recording surface

Good: Almost no peeling of recording surface

Fair: Some peeling of recording surface

Poor: A lot of peeling of recording surface

[Stability of Blank Part During Storage]

A thermosensitive recording medium was left to stand for 72 hr on a dryer with air blower kept at 60° C., and the difference of the brightness between before and after the test was measured by a Hunter's brightness meter (Filter: Am).

Good: Lowering of brightness less than 2 points

Fair: Lowering of brightness equal to or more than 2 points and less than 10 points Poor: Lowering of brightness equal to or more than 10 points.

The results of the evaluation are shown in the following tables.

TABLE 1

| | | Example 1 | Example 2 | Example 3 | Example 4 | Comparative Example 1 | Comparative Example 2 | Comparative Example 3 | Comparative Example 4 | Comparative Example 5 |
|---|---|---|---|---|---|---|---|---|---|---|
| color developing sensitivity | 0.25 mj/dot | 0.98 | 1.01 | 1.03 | 0.95 | 1.03 | 1.04 | 1.01 | 0.81 | 1.02 |
| | 0.34 mj/dot | 1.32 | 1.32 | 1.33 | 1.29 | 1.36 | 1.34 | 1.35 | 1.28 | 1.37 |
| surface strength 1 | | Excellent | Excellent | Good | Excellent | Poor | Poor | Poor | Poor | Good |
| surface strength 2 | | | | | | | | | | |
| printing run-ability 1 | | Good | Excellent | Good | Good | Good | Fair | Fair | Good | Poor |
| printing run-ability 2 | | | | | | | | | | |
| water resistance | | Good | Good | Good | Good | Poor | Fair | Fair | Poor | Poor |
| stability of blanc part | | Good | Good | Good | Good | Fair | Fair | Fair | Fair | Fair |

TABLE 2

| | | Example 5 | Example 6 | Example 7 | Example 8 | Example 9 | Comparative Example 6 | Comparative Example 7 | Comparative Example 8 | Comparative Example 9 |
|---|---|---|---|---|---|---|---|---|---|---|
| color developing sensitivity | 0.25 mj/dot | 1.00 | 0.98 | 0.93 | 1.04 | 0.95 | 0.98 | 0.99 | 0.84 | 0.96 |
| | 0.34 mj/dot | 1.33 | 1.34 | 1.29 | 1.38 | 1.30 | 1.30 | 1.31 | 1.15 | 1.30 |
| surface strength 1 | | | | | | | | | | |
| surface strength 2 | | Good | Good | Good | Fair | Good | Poor | Fair | Poor | Fair |
| printing run-ability 1 | | | | | | | | | | |
| printing run-ability 2 | | Good | Fair | Good | Fair | Good | Poor | Poor | Good | Poor |
| water resistance | | Excellent | Excellent | Excellent | Good | Excellent | Poor | Fair | Good | Fair |
| stability of blanc part | | Good | Fair | Good | Good | Good | Fair | Fair | Poor | Fair |

What is claimed is:

1. A thermosensitive recording medium having a thermosensitive recording layer containing colorless or pale colored electron-donating leuco dye and electron-accepting color development agent on a substrate, wherein the thermosensitive recording layer comprises an alkylketene dimer.

2. The thermosensitive recording medium of claim 1, wherein the thermosensitive recording layer further comprises an acrylate resin as a binder.

3. The thermosensitive recording medium of claim 1 or 2, wherein a protecting layer is not installed on the thermosensitive recording layer.

* * * * *